US007439966B2

(12) United States Patent
Tai

(10) Patent No.: US 7,439,966 B2
(45) Date of Patent: Oct. 21, 2008

(54) DATA DRIVER AND DRIVING METHOD THEREOF

(75) Inventor: Ya-Hsiang Tai, Hsinchu (TW)

(73) Assignee: TPO Displays Corp., Chu-Nan (TW)

( * ) Notice: Subject to any disclaimer, the term of this patent is extended or adjusted under 35 U.S.C. 154(b) by 596 days.

(21) Appl. No.: 10/916,006

(22) Filed: Aug. 10, 2004

(65) Prior Publication Data

US 2005/0195177 A1 Sep. 8, 2005

(30) Foreign Application Priority Data

Mar. 3, 2004 (TW) ..... 93105480 A

(51) Int. Cl.
*G09G 5/00* (2006.01)

(52) U.S. Cl. ..... 345/204; 345/211; 345/214; 345/205; 345/206

(58) Field of Classification Search ..... 345/87, 345/89, 74.1, 74, 98, 76, 100, 102, 691, 204, 345/206, 55, 205, 214, 211; 340/711, 309.4; 375/257; 257/30; 315/169.1; 710/100, 56; 713/178, 181; 700/301
See application file for complete search history.

(56) References Cited

U.S. PATENT DOCUMENTS 3,903,515 A * 9/1975 Haydon et al. ..... 340/309.4
4,277,784 A * 7/1981 Hyltin ..... 345/87
4,872,002 A * 10/1989 Stewart et al. ..... 345/55
4,963,860 A * 10/1990 Stewart ..... 345/206
5,038,277 A * 8/1991 Altman et al. ..... 710/56
5,371,517 A * 12/1994 Izzi et al. ..... 345/589
5,521,449 A * 5/1996 Tao ..... 315/169.1
5,594,473 A * 1/1997 Miner et al. ..... 345/600
5,802,317 A * 9/1998 Wiseman et al. ..... 710/100
5,900,853 A 5/1999 Shimizu et al.
6,069,597 A * 5/2000 Hansen ..... 345/74.1
6,646,283 B1 * 11/2003 Akimoto et al. ..... 257/30
6,944,239 B2 * 9/2005 Cecchi et al. ..... 375/316
7,054,374 B1 * 5/2006 Jensen et al. ..... 375/257
7,082,538 B2 * 7/2006 Bouchard et al. ..... 713/181
2001/0048419 A1 * 12/2001 Stevens ..... 345/89
2002/0036634 A1 * 3/2002 Pinkham et al. ..... 345/204
2002/0060656 A1 * 5/2002 Okuzono ..... 345/88
2002/0091928 A1 * 7/2002 Bouchard et al. ..... 713/178
2003/0098860 A1 * 5/2003 Nakamura et al. ..... 345/211
2003/0169246 A1 * 9/2003 Park ..... 345/204
2004/0193330 A1 * 9/2004 Mehaffey et al. ..... 700/301
2004/0222961 A1 * 11/2004 Lin et al. ..... 345/103
2005/0190134 A1 * 9/2005 Wang et al. ..... 345/87

OTHER PUBLICATIONS

ASID/99 Spectroscopic Analysis in Lase Annealing Chung-Jung Shih et al. (1999).*
Characteristic of Low-Temperature Poly-Si TFTs on A1/Glass Substrate Yasuyoshi et al. (2001).*
Journal of Applied Physics Toshiharu Suzuki (Jun. 2006).*

* cited by examiner

*Primary Examiner*—Prabodh Dharia
(74) *Attorney, Agent, or Firm*—Liu & Liu

(57) ABSTRACT

A data driver and a method of driving the data driver are disclosed. A multiplexer receives data signals from a signal source. A control circuit periodically outputs a plurality of control signals to the multiplexer. When the multiplexer receives the control signals, transistors of the multiplexer are turned on for driving different loads with a data signal at different timings or for driving the same load with different signals at different timings.

9 Claims, 5 Drawing Sheets

DATA DRIVER AND DRIVING METHOD THEREOF

CROSS-REFERENCE TO RELATED APPLICATION

This application claims the priority benefit of Taiwan application serial no. 93105480, filed on Mar. 3, 2004.

BACKGROUND OF THE INVENTION

1. Field of the Invention

The present invention relates to a data driver and a method of driving this data driver, and more particularly to a distribution-driving method of driving this data driver.

2. Description of the Related Art

Presently smaller, compact and lighter, displays and portable devices are available to consumers. As to displays, cathode ray tubes (CRT) have had dominated the market because of their high quality and low cost. However, because of larger space occupation, higher power consumption, radiation hazard and concern of environmental protection, CRT technology still needs to resolve the aforementioned issues. Therefore, with the emergence of flap panel display, such as thin film transistor liquid crystal display, and its advantageous features such as high quality, smaller space occupation, low power consumption and radiation free, the thin film transistor liquid crystal display (TFT LCD) has gradually replaced CRT.

Referring to FIG. 4, a schematic view of a prior art data line driving circuit is shown. As shown in FIG. 4, the signal source with the three data signals is coupled to and drives three data lines R, G and B, which operatively activate respective red, green and blue pixels (not shown).

Referring to FIG. 5, a schematic view of another prior art data line driving circuit is shown. As shown in FIG. 5, the signal source with the three data signals is coupled to three sets of data lines 502, 504 and 506. The data line set 502 includes three data lines RA, GA and BA, the data line set 504 includes three data lines RB, GB and BB, and the data line set 506 includes three data lines RC, GC and BC. Each of the data line set is driven by the data signals of the signal source coupled thereto separately. The visual voltages (i.e., voltage outputs for the pixels) of each data signals are isolated from each other, where one data signal does on affect the visual voltages of the data lines corresponding to the other data signals.

In the prior art data line driving method of a display panel, because of the independence of the data signals, each visual voltage driving each pixel will vary between the respective signal sources. Generally, the visual voltage variation will be about 5 to 50 mV because of manufacturing process limitation. This variation will affect the gray level of the display and result in non-uniformity of the images.

SUMMARY OF THE INVENTION

The present invention overcomes drawbacks in the prior art, by scrambling the association of the data signals and the loads, in a distributed-driving manner, such that the same load may be driven with different data signals at different timings or different loads may be driven with the same data signal at different timings, so as to improve the output uniformity of the data driver of a display panel and the images thereof. The driver circuit is structured and configured to selectively drive a selected one of the loads using the data signal from a selected one of the data sources, and a controller controls the selection of the selected data source and the selected load, to associate the load to the data source at a particular timing.

According one perspective of the present invention, a data driver, which includes a multiplexer or a selector is provided between a signal source and a data line so that the signal source drives the data line using the distribution-driving method.

According to another perspective of the present invention, a data driver, which includes a multiplexer or a selector is provided between a signal source and loads coupled to a plurality of data lines so that the signal source drives the loads using the distribution-driving method.

The present invention provides a method of driving a data driver. The data driver comprises a plurality of data driving units. The method of driving the data driver comprises first providing data signals from the signal source in which the data driver is coupled to a plurality of loads. Then, the multiplexer of the data driver drives the same load with the different data signals at different timings via the data driving units according to a plurality of control signals from the control circuit or drives different loads with one of the data signals at different timings via the data driving units according to a plurality of control signals from the control circuit.

The present invention provides a data driver, which is coupled to the loads and the signal source having a plurality of data signals. The data driver comprises a multiplexer and a control circuit, wherein the multiplexer includes a plurality of data driving units, a plurality of input terminals and a plurality of output terminals for receiving the data signals. The control circuit is coupled to the multiplexer and periodically transmits one of the control signals so that the multiplexer drives the same load with different data signals at different timings via the data driving units according to the control signals or drives different loads with one of the data signals at different timings via the data driving units according to a plurality of control signals from the control circuit.

In order to make the aforementioned and other objects, features and advantages of the present invention understandable, a preferred embodiment accompanied with figures is described in detail below.

DESCRIPTION OF SOME EMBODIMENTS

The feature of the present invention is in using different data signals to drive the same load at different timings or using the same data signal to drive the different loads at different timings.

Figure 1:
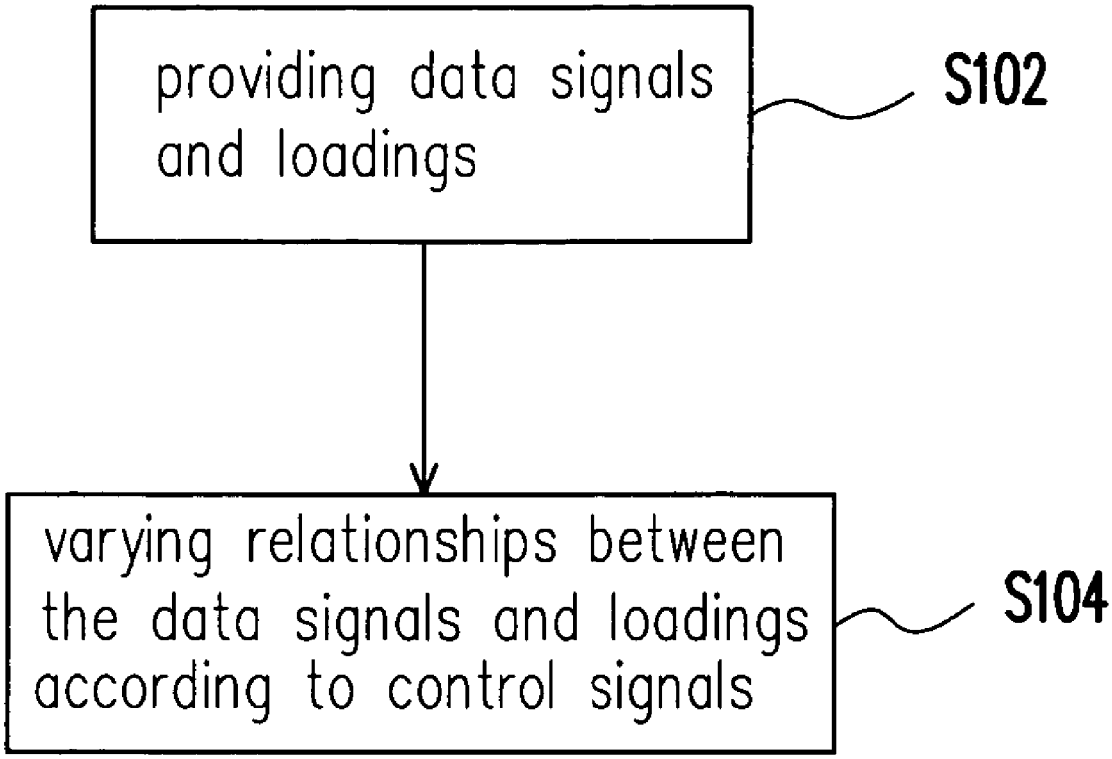
FIG. 1 is a schematic flow chart showing a method of driving a data driver according to a preferred embodiment of the present invention.
Figure 2:
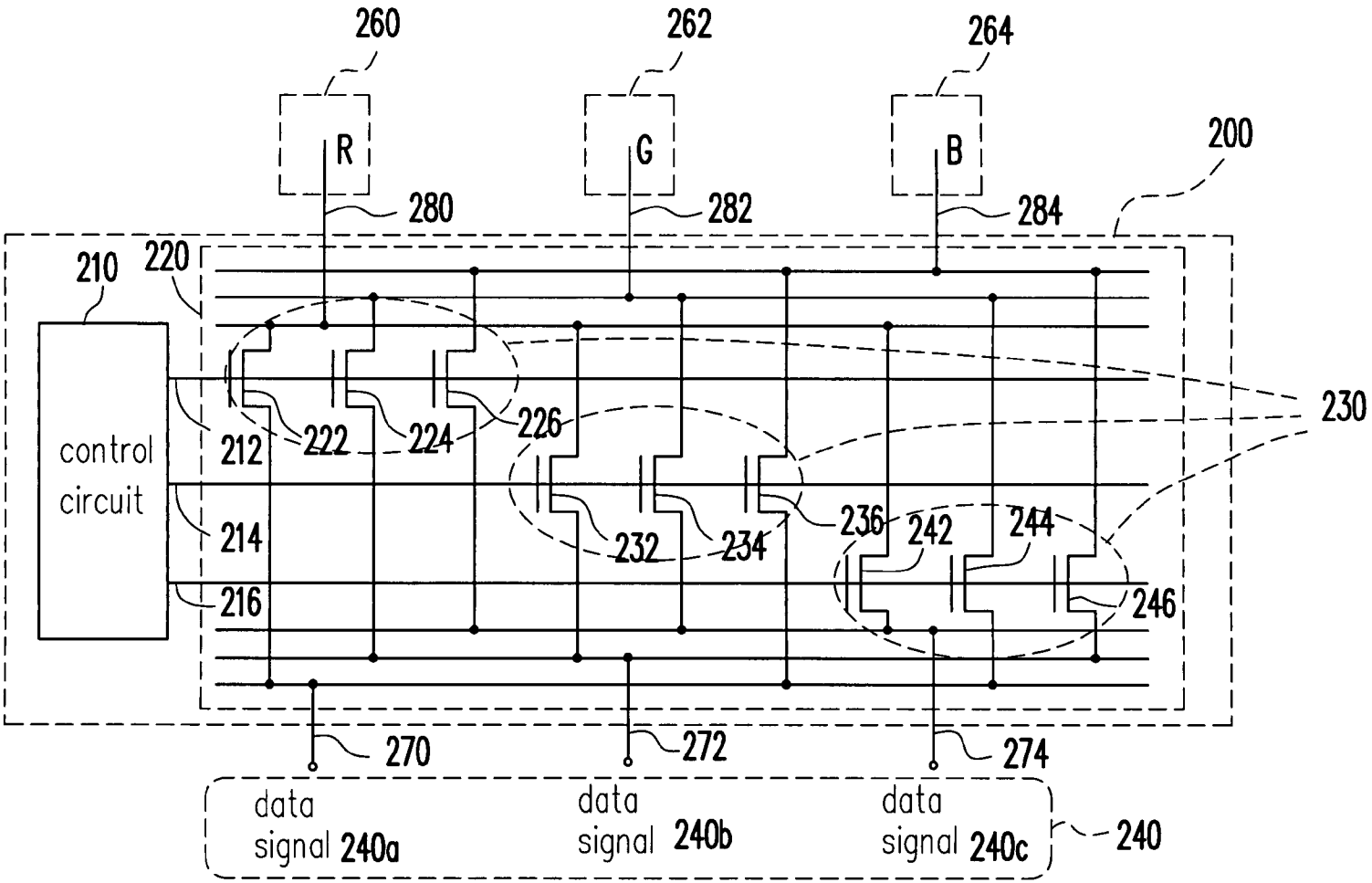
FIG. 2 is a schematic drawing showing a data driver circuit according to a preferred embodiment of the present invention.

Referring to FIG. 1, a schematic flow chart of a method of driving a data driver according to preferred embodiment of the present invention which is adapted for a display panels is shown. One of ordinary skill in the art will understand that the display panel can be a liquid crystal display or an organic electro-luminance panel display, but not limited thereto. The data driver includes a multiplexer 220 having a plurality of data driving units 230 and a control circuit 210 (FIG. 2).

In step s102, a plurality of data signals is received by the multiplexer and the data driver is coupled to a plurality of loads of the display panel.

In step s104, when the multiplexer receives the control signals, a variety of relationships between the data signals and the loads are generated in accordance with the control signals generated from the control circuit.

In the preferred embodiment of the present invention, one of the relationships between the data signals and the loads is to drive the same load with different data signals via the data driving units at different timings.

In the preferred embodiment of the present invention, another relationship between the data signals and the loads is to drive different loads with the same data signal via the data driving units at different timings.

Referring to FIG. 2, a schematic view of a data driver circuit according to a preferred embodiment of the present invention is shown. In the embodiment, three loads are shown, but is not limited thereto.

In FIG. 2, the data driver 200 is coupled to loads 260, 262 and 264, and a signal source 240 has three data signals 240*a*, 240*b* and 240*c*. The data driver 200 includes a control circuit 210 and a multiplexer 220. In the embodiment, the multiplexer has three output terminals 280, 282 and 284, and three input terminals 270, 272 and 274 for receiving and transmitting the data signals. The control circuit 210 is coupled to the multiplexer 220 and periodically transmits one of the three control signals. In one embodiment of the present invention, these control signals are transmitted in a fixed order periodically. However, these control signals could be outputted in any random order so that only one of the data driving units 230 is turned on. According to one of the control signals, the multiplexer 220 outputs one of the data signals 240*a*, 240*b*, 240*c* to one of the loads 260, 262 and 264. The output terminal 280 is coupled to the load 260, the output terminal 282 is coupled to the load 262 and the output terminal 284 is coupled to the load 264.

In the embodiment, the multiplexer 220 comprises control lines 212, 214 and 216 for receiving the control signals from the control circuit. The control line 212 is coupled to transistors 222, 224 and 226 in parallel; the control line 214 is coupled to transistors 232, 234 and 236 in parallel; and the control line 216 is coupled to transistors 242, 244 and 246 in parallel. Each of the gate terminals of the transistors is coupled to the control line corresponding thereto in parallel. Each drain terminal of the transistors is coupled to one of the input terminals 270, 272 and 274 of the multiplexer 220 and each source terminal of the transistors is coupled to one of the output terminals 280, 282 and 284 of the multiplexer 220.

In the embodiment, when the multiplexer 220 receives the data signals, the control circuit 210 outputs control signals to control line 212 for turning on transistors 222, 224 and 226. Therefore, the data signal drives the load 260 through the input terminal 270; the data signal drives the load 262 through the input terminal 272; and the data signal drives the load 264 through the input terminal 274.

When the control circuit 210 outputs control signals to control line 214, transistors 232, 234 and 236 are turned on. Therefore, the data signal drives the load 264 through the input terminal 270; the data signal drives the load 260 through the input terminal 272; and the data signal drives the load 262 through the input terminal 274.

When the control circuit 210 outputs control signals to control line 216, transistors 242, 244 and 246 are turned on. Therefore, the data signal drives the load 262 through the input terminal 270; the data signal drives the load 264 through the input terminal 272; and the data signal drives the load 260 through the input terminal 274.

In the embodiment of the present invention, one of ordinary skill in the art will understand that the load 260 can be a red data line of a display panel, the load 262 can be a green data line of a display panel and the load 264 can be a blue data line of a display panel, but they are not limited thereto.

Figure 3:
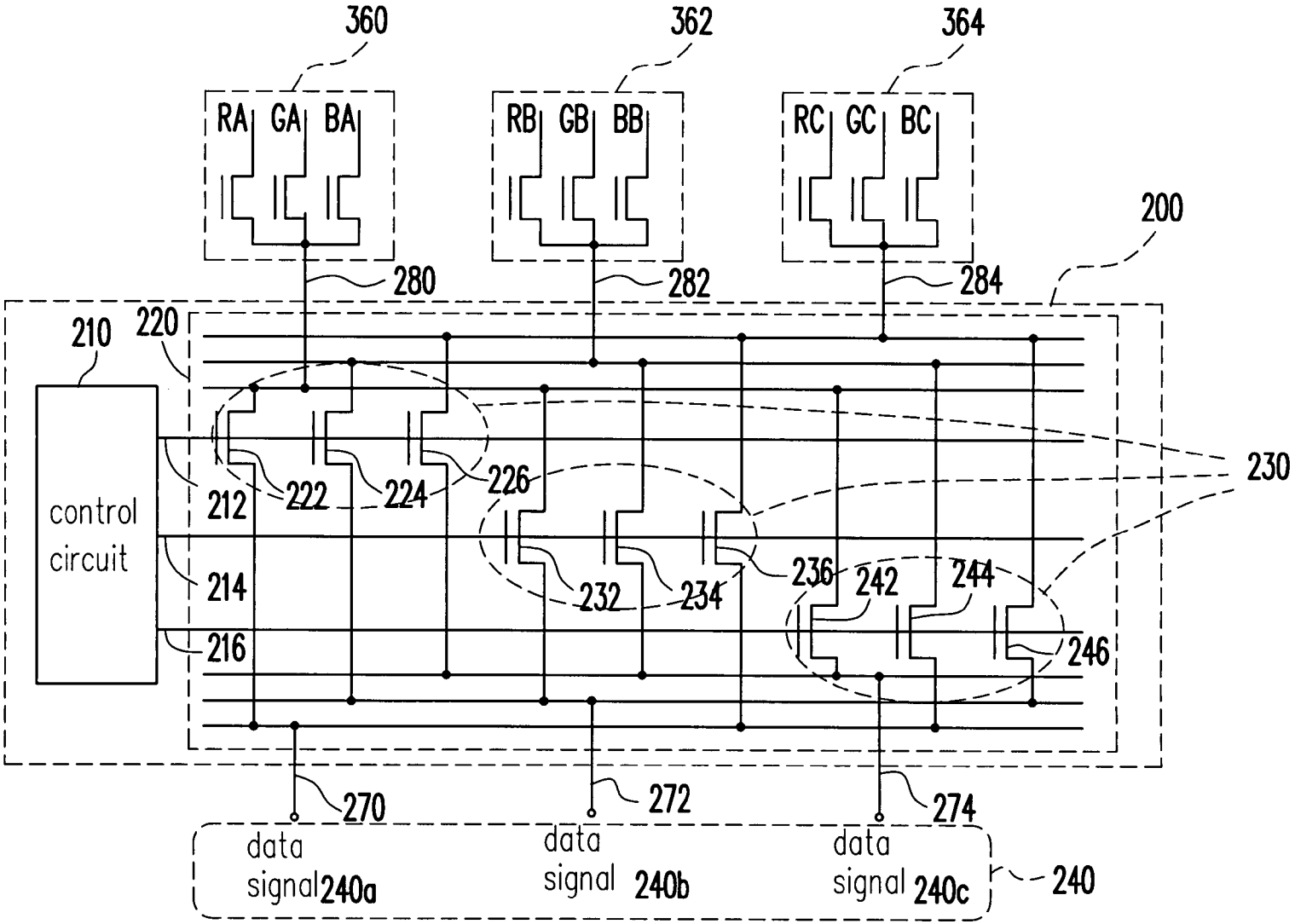
FIG. 3 is a schematic drawing showing data driver circuit according to another preferred embodiment of the present invention.
Figure 4:
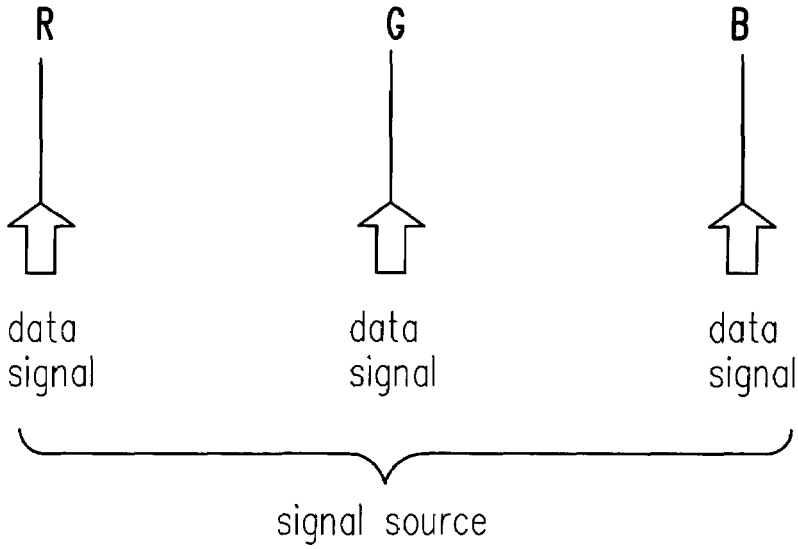
FIG. 4 (PRIOR ART)
FIG. 4 is a schematic view showing a prior art data line driving circuit.
Figure 5:
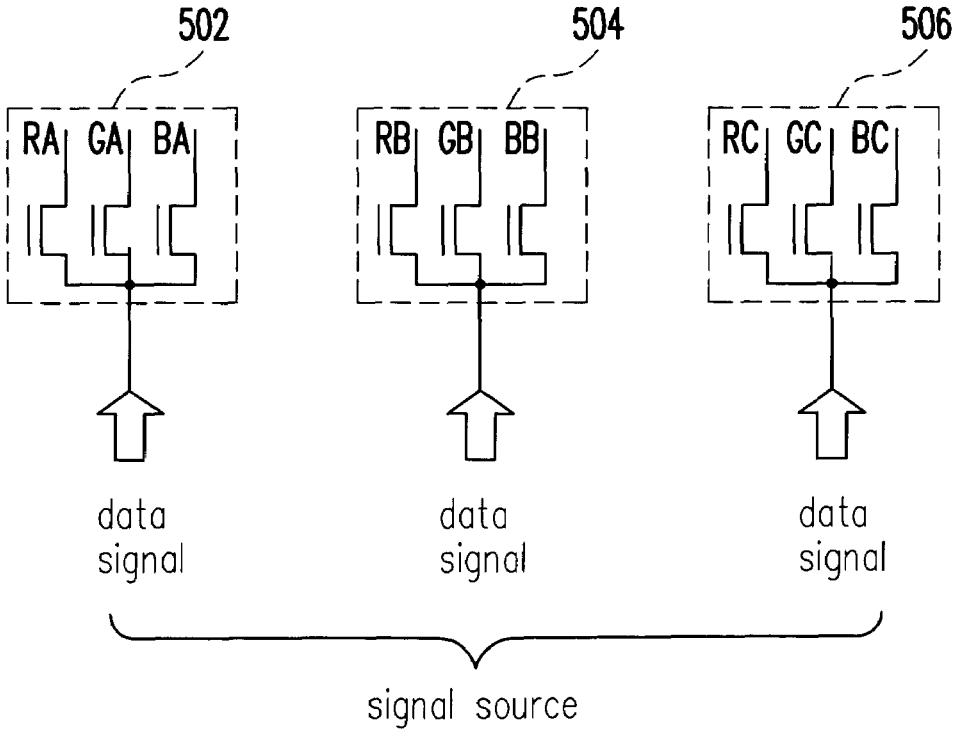
FIG. 5 (PRIOR ART)
FIG. 5 is a schematic view showing another prior art data line driving circuit.

Referring to FIG. 3, a schematic view of a data driver circuit according to another preferred embodiment of the present invention. The difference between the embodiments shown in FIGS. 2 and 3 is that the load 360 includes three data lines RA, GA and BA, the load 362 includes three data lines RB, GB and BB and the load 364 includes three data lines RC, GC and BC in FIG. 3.

Referring to FIG. 3, in the embodiment when the multiplexer 220 receives the data signals, the control circuit 210 outputs control signals to control line 212 for turning on transistors 222, 224 and 226. Therefore, the data signal drives the data lines RA, GA and BA of the load 360 through the input terminal 270; the data signal drives the data lines RB, GB and BB of the load 362 through the input terminal 272; and the data signal drives the data lines RC, GC and BC of the load 364 through the input terminal 274.

When the control circuit 210 outputs control signals to control line 214, transistors 232, 234 and 236 are turned on. Therefore, the data signal drives the data lines RC, GC and BC of the load 364 through the input terminal 270; the data signal drives the data lines RA, GA and BA of the load 360 through the input terminal 272; and the data signal drives the data lines RB, GB and BB of the load 362 through the input terminal 274.

When the control circuit 210 outputs control signals to control line 216, transistors 242, 244 and 246 are turned on. Therefore, the data signal drives the data lines RB, GB and BB of the load 362 through the input terminal 270; the data signal drives the data lines 362RC, GC and BC of the load 364 through the input terminal 272; and the data signal drives the data lines RA, GA and BA of the load 360 through the input terminal 274.

In the embodiment of the present invention, the transistors 222, 224 and 226 can be included in a data driving unit, but not limited thereto.

In the embodiment of the present invention, the transistors 222, 224, 226, 232, 234, 236, 242, 244 and 246 can be low-temperature poly-silicon transistors.

In the embodiment of the present invention, one of ordinary skill in the art will know that the multiplexer 220 can be a selector, but not limited thereto.

Accordingly, the method of driving the data driver of the present invention can be used to drive different data lines by different data signals sequentially. Therefore, it can improve the output uniformity of the data driver of a panel display and the images thereof.

Figure 6:
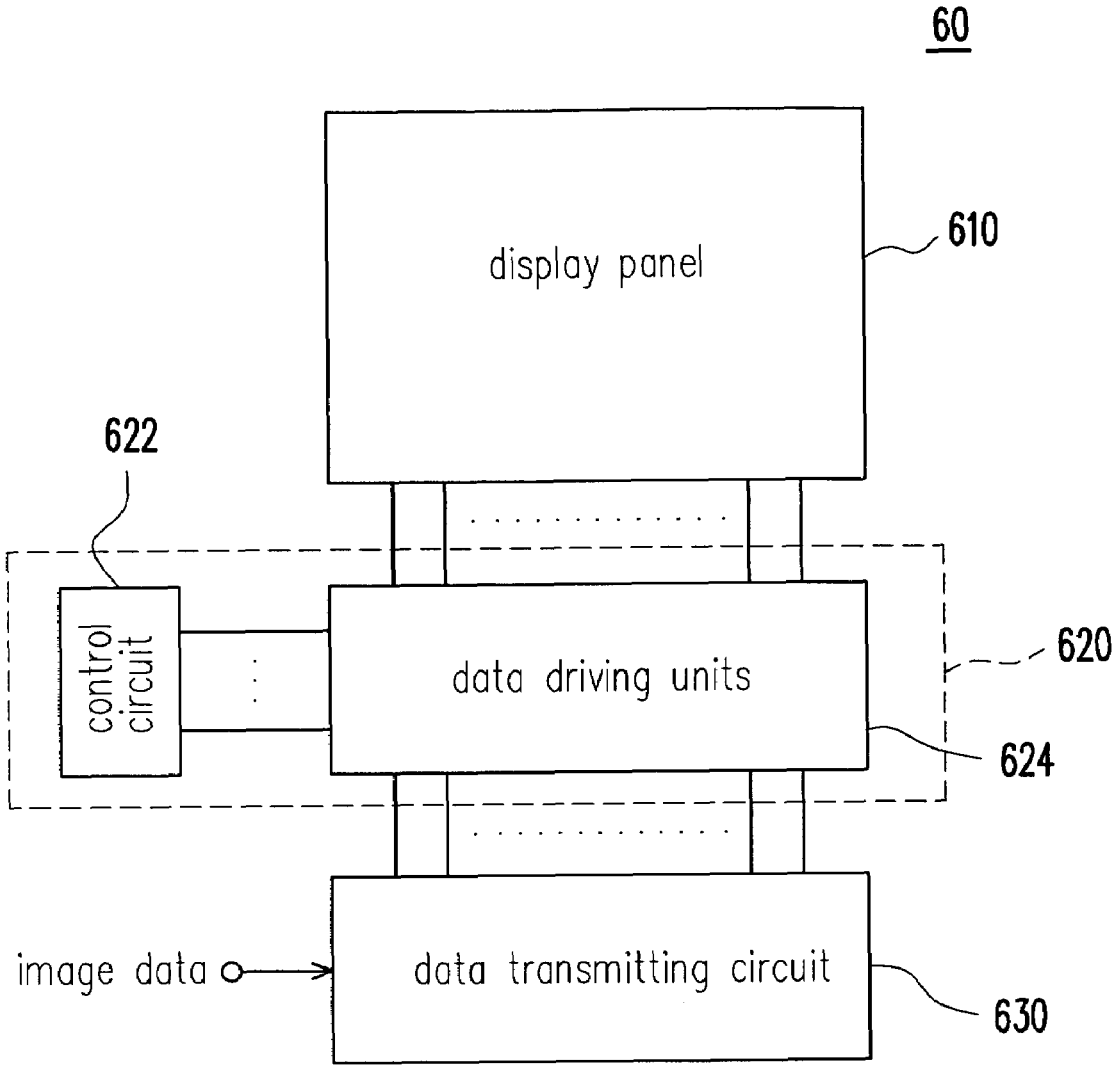
FIG. 6 is a schematic view showing an electronic device according to one embodiment of the present invention.

Referring to FIG. 6, a schematic view of an electronic device according to one embodiment of the present invention is shown. In the embodiment, electronic device 60 includes a display panel 610, a data driver 620 which is in accordance to an embodiment of the present invention, and a data transmitting circuit 630. The data transmitting circuit 630 receives image data and outputs the image data to the data driver 620. In the data driver 620, control circuit 622 controls the data driving units 624 for selectively output the image data to the display panel 610 as described in the above mentioned embodiment.

Although the present invention has been described in terms of exemplary embodiments, it is not limited thereto. Rather, the appended claims should be constructed broadly to include other variants and embodiments of the invention which may be made by those skilled in the field of this art without departing from the scope and range of equivalents of the invention.

What is claimed is:

1. A data driver coupled to a plurality of loads and a signal source having a plurality of data signals, and comprising:.

a multiplexer, comprising a plurality of data driving units, a plurality of input terminals and a plurality of output terminals; and a control circuit, coupled to the multiplexer, periodically transmitting one of the control signals;

wherein the multiplexer drives the same load with different selected data signals at different selected time via the data driving units according to the control signals, wherein the loads are data lines transmitting red, green and blue signals driven by plurality of transistors to display pixels.

2. The data driver claim 1, wherein the multiplexer further comprises a plurality of control lines for receiving the control signals from the control circuit and one of the control lines is coupled to one of the data driving units.

3. The data driver of claim 2, wherein each of the data driving units comprises a plurality of transistors, each of the gate terminals of the transistors is coupled to one of the control lines, each of the drain terminals of the transistors is coupled to one of the input terminals of the multiplexer and each of the source terminals of the transistors is coupled to one of the output terminals of the multiplexer.

4. The data driver of claim 3, wherein the transistors are low-temperature poly-silicon transistors.

5. An electronic device, comprising:

a. display panel for displaying an image;

a data driver as claimed in claim 1 electrically coupled to the display panel for selectively outputting data of the image to the display panel; and a control circuit for receiving the image and output the image to the data driver.

6. A data driver coupled to a plurality of loads and a signal source having a plurality of data signals, and comprising:

a multiplexer, comprising a plurality of data driving units, a plurality of input terminals and a plurality of output terminals; and a control circuit, coupled to the multiplexer, periodically transmitting one of the control signals;

wherein the multiplexer drives different selected loads with one of the data signals at different selected time via the data driving units according to the control signals, wherein the loads are data lines transmitting red, green and blue signals driven by plurality of transistors to display pixels.

7. The data driver of claim 6, wherein the multiplexer further comprises a plurality of control lines for receiving the control signals from the control circuit and one of the control lines is coupled to one of the data driving units.

8. The data driver of claim 7, wherein each of the data driving units comprises a plurality of transistors, each of the gate terminals of the transistors is coupled to one of the control lines, each of the drain terminals of the transistors is coupled to one of the input terminals of the multiplexer and each of the source terminals of the transistors is coupled to one of the output terminals of the multiplexer.

9. The data driver of claim 8, wherein the transistors are low-temperature poly-silicon transistors.

* * * * *